US006818606B1

(12) United States Patent
Hanada et al.

(10) Patent No.: US 6,818,606 B1
(45) Date of Patent: Nov. 16, 2004

(54) ARTICLE FOR USE IN WASHING IN SHEET FORM

(75) Inventors: Hirohiko Hanada, Wakayama (JP); Nobuyoshi Yamaguchi, Wakayama (JP); Kazutoshi Ide, Wakayama (JP); Hiroyuki Saijo, Wakayama (JP); Hiromitsu Hayashi, Wakayama (JP); Hiroyuki Yamashita, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/980,203

(22) PCT Filed: Mar. 27, 2000

(86) PCT No.: PCT/JP00/01864

§ 371 (c)(1),
(2), (4) Date: Jan. 18, 2002

(87) PCT Pub. No.: WO00/77156

PCT Pub. Date: Dec. 21, 2000

(30) Foreign Application Priority Data

Jun. 16, 1999 (JP) ..... 11-169298

(51) Int. Cl.[7] ..... C11D 17/06
(52) U.S. Cl. ..... 510/296
(58) Field of Search ..... 510/296, 439, 510/445

(56) References Cited

U.S. PATENT DOCUMENTS

| | | | | |
|---|---|---|---|---|
| 3,676,338 A | | 7/1972 | Fries et al. | |
| 3,953,350 A | | 4/1976 | Fujino et al. | |
| 4,064,063 A | | 12/1977 | Alder et al. | |
| 4,199,465 A | * | 4/1980 | Rodriguez | 252/91 |
| 4,610,799 A | | 9/1986 | Wilsberg et al. | |
| 4,752,408 A | | 6/1988 | Koester et al. | |
| 4,806,261 A | * | 2/1989 | Cialella et al. | 252/90 |
| 4,919,835 A | * | 4/1990 | Sigl et al. | 252/91 |

FOREIGN PATENT DOCUMENTS

| | | |
|---|---|---|
| DE | 4 124 701 | 1/1993 |
| EP | 0 109 565 | 5/1984 |
| EP | 118191 A1 * | 9/1984 |
| EP | 0 234 867 | 9/1987 |
| EP | 0 291 198 | 11/1988 |
| EP | 0 327 963 | 8/1989 |
| EP | 0 481 793 | 4/1992 |
| EP | 0 643 129 | 3/1995 |
| JP | 55-165998 | 12/1980 |
| JP | 63-8498 | 1/1988 |
| JP | 63-12466 | 1/1988 |
| JP | 10-20299 | 1/1989 |
| JP | 3-265699 | 11/1991 |
| JP | 4-202600 | 7/1992 |
| JP | 4-348198 | 12/1992 |
| JP | 8-118559 | 5/1996 |
| JP | 8-325599 | 12/1996 |
| JP | 9-279194 | 10/1997 |
| JP | 10-72593 | 3/1998 |
| JP | 10-72599 | 3/1998 |
| JP | 10-72600 | 3/1998 |
| JP | 11-21594 | 1/1999 |
| JP | 11-124600 | 5/1999 |
| JP | 11-228996 | 8/1999 |
| JP | 2000-26899 | 1/2000 |
| JP | 2000-34494 | 2/2000 |
| WO | 92/06162 | 4/1992 |
| WO | 94/04656 | 3/1994 |
| WO | 94/11488 | 5/1994 |
| WO | 94/16052 | 7/1994 |
| WO | 98/32835 | 7/1998 |
| WO | WO 99/10467 A1 | 3/1999 |

OTHER PUBLICATIONS

Abstract EP 220676 A, Derwent WPI Accession No. 1987–124269/198718 (May 6, 1987).
Abstract DE 2449354 A, Derwent WPI Accession No. 1976–34111X/197619 (Apr. 29, 1976).
Abstract DE 2703505 A, Derwent WPI Accession No. 1977–56068Y/197732 (Aug. 4, 1977).
Abstract BE 842014 A, Derwent WPI Accession No. 1976–90605X/197649 (Nov. 22, 1976).
Abstract EP 120492 A, Derwent WPI Accession No. 1984–245048/198440 (Oct. 3, 1984).
Abstract DE 2514676 A, Derwent WPI Accession No. 1975–72755W/197544 (Oct. 23, 1975).
Abstract WO 9404656, Derwent WPI Accession No. 1994–083176/199410 (Mar. 3, 1994).
Abstract DE 2226870 A, Derwent WPI Accession No. 1974–00182V/197401 (Jun. 2, 1972).
Abstract NL 7307820 A, Derwent WPI Accession No. 1974–04935V/197403 (Jan. 7, 1974).

* cited by examiner

*Primary Examiner*—John R. Hardee
(74) *Attorney, Agent, or Firm*—Birch, Stewart, Kolasch & Birch, LLP

(57) ABSTRACT

The present invention provides a laundry detergent sheet with significant improvements in solubility. That is, the invention provides a sheet of laundry detergent comprising a layer containing a detergent composition and a water-soluble substrate provided on both sides of the layer, wherein said layer comprises a water-soluble or disintegrating-in-water particle group, having an average particle diameter of 60 to 2000 μm, consisting of a particle group. The water-soluble or disintegrating-in-water particle group means less than 0.025 g of residue on a screen after 0.5 g of the particle group is introduced into 1 L water at 10° C., stirred at a revolution rate of 800 rpm for 10 minutes, and sifted through a screen of 200 mesh size.

1 Claim, No Drawings

ARTICLE FOR USE IN WASHING IN SHEET FORM

This application is the national phase under 35 U.S.C. § 371 of PCT International Application No. PCT/JP00/01864 which has an International filing date of Mar. 27, 2000, which designated the United States of America.

TECHNICAL FIELD

The present invention relates to a laundry detergent sheet.

BACKGROUND ART

A laundry detergent sheet provided with a layer containing a cleansing composition and a bleaching agent and on both sides of said layer with a water-soluble substrate is known (JP-A 10-72599, JP-A 10-72593 or WO98/32835). However, since the detergent is in sheet, its surface area is smaller than the area of a powdered detergent, and since its ingredients are compressed, the laundry detergent sheet is still poor in solubility at low temperatures.

DISCLOSURE OF INVENTION

Accordingly, the object of the present invention is to provide a laundry detergent sheet with significant improvements in solubility.

The present invention relates to a laundry detergent sheet comprising a layer containing a detergent composition and, on both sides of the layer, a water-soluble substrate joined, wherein said layer comprises a water-soluble or disintegrating-in-water particle group having an average particle diameter of 60 to 2000 μm, consisting of a particle group obtained by spray-drying slurry containing at least one member selected from a water-soluble inorganic material, a water-insoluble or water-sparingly-soluble inorganic material and a water-soluble organic material, and/or a detergent particle group comprising a surfactant carried on said particle group.

MODES FOR CARRYING OUT THE INVENTION

[Water-soluble and/or Disintegrating-In-Water Particle Group]

The layer containing a detergent composition, which constitutes the laundry detergent sheet of the present invention, comprises a water-soluble or disintegrating-in-water particle group having an average particle diameter of 60 to 2000 μm, consisting of a particle group obtained by spray-drying slurry containing at least one member selected from a water-soluble inorganic material, a water-insoluble or water-sparingly-soluble inorganic material and a water-soluble organic material, and/or a detergent particle group comprising a surfactant carried on said particle group. The phrase "water-soluble or disintegrating-in-water" refers to such properties that when 0.5 g of said particle group is introduced into 1-L water at 10° C. in a 1-L beaker (in the form of a cylinder having an inner diameter of 105 mm and a height of 150 mm, for example a 1-L beaker produced by Iwaki Glass Co., Ltd.), stirred for 10 minutes at a revolution rate of 800 rpm with a stirrer (35 mm length and 8 mm diameter), and then sifted through a metal screen of 200 mesh size, the residue on the screen is less than 0.025 g. The "water-soluble or disintegrating-in-water" is preferably such that under said conditions, the time for the residue to be reduced to less than 0.025 g is within 7 minutes, particularly within 5 minutes.

The average particle diameter of said water-soluble or disintegrating-in-water particle group, as determined with the standard screen in JIS Z 8801, is 60 to 2000 μm, preferably 88 to 1410 μm, more preferably 125 to 1000 μm. It is preferable that the particle group having particle diameters less than the lower limit of the average particle diameter is less than 5% by weight of the whole particle group, while the particle group having particle diameters greater than the upper limit is less than 5% by weight of the whole particle group. If the average particle diameter is less than 60 μm, the effect of improving solubility is insufficient, while if the average particle diameter is greater than 2000 μm, the particles after washing easily remain in clothes and a washing machine.

The water-soluble or disintegrated particle group in the present invention is preferably the one having the following characteristics<1> and <2>.

<1> In the process of dissolution in water, bubbles having an at least one-tenth diameter relative to the diameter of the particles are released from the inside of the particles (particles releasing bubbles are referred to hereinafter as "bubble-releasing particles").

The bubble-releasing particles refer to those particles which upon penetration of a small amount of water into the inside of the particles, release bubbles having a predetermined size from the inside of the particles, and then upon penetration of a large amount of water into the inside of the particles, disintegrate by themselves (autonomous disintegration of the particles) in the process of dissolution in water, whereby the dissolution of the particles starts not only from the vicinity of the surface but also from the inside of the particles. The behavior of this dissolution can be confirmed under a digital microscope, an optical microscope etc. as the phenomenon where upon dissolution in water, the bubble-releasing detergent particles release bubbles whose diameter is at least 1/10, preferably at least 1/5, more preferably at least 1/4 and most preferably at least 1/3 (referred to hereinafter as bubbles of the predetermined size) relative to the diameter of the particles. Upon dissolution in water in a stationary state, the bubble-releasing detergent particles generate bubbles of the predetermined size preferably within 120 seconds, more preferably within 60 seconds and most preferably within 45 minutes.

The method of measuring the diameter of bubbles is as follows: A double-coated tape is attached to the center of the bottom of a Petri dish (inner diameter: 50 mm). The water-soluble or disintegrating-in-water particle group is attached to the double-coated tape. First, the diameter (αμm) of individual particles in circular form is determined from its picture obtained using a digital microscope. As the digital microscope, VH-6300 produced by Keyence Co. Ltd. can be used. Then, 5 mL deionized water at 20° C. is poured into the Petri dish, and the dissolution behavior of the individual particles to be measured is observed. If bubbles are released from the inside of the particles, the diameter (βμm) of bubbles in circular form is determined from a picture of the bubbles just released from the particles. If plural bubbles are released from the inside of the particles, the maximum diameter (βμm) of the individual bubbles in circular form is determined. Then, the ratio (β/α) of bubble diameter to particle diameter is determined for the individual particles. It is preferable that in the inside of the bubble-releasing detergent particles, there are pores having a diameter of 1/10 to 4/5, preferably 1/5 to 4/5, relative to the particle diameter.

<2> When the particles are introduced into water at 5° C., stirred for 60 seconds under the following conditions and sifted through the standard screen (opening of 74 μm) prescribed in JIS Z 8801, the degree of dissolution of the particle group, as calculated by equation (1), is at least 90%.

Stirring conditions: 1 g of the particle group is introduced into 1 L hard water (71.2 mg $CaCO_3$/L; molar ratio of Ca/Mg=7/3) and stirred at a revolution rate of 800 rpm with a stirrer (length, 35 mm; diameter, 8 mm) in a 1-L beaker (inner diameter, 105 mm).

$$\text{Degree of dissolution (\%)}=[1-(T/S)]\times 100 \quad (1)$$

S: Weight (g) of the particle group introduced.

T: Dry weight (g) of the residue (from the particle group) remaining on the screen through which the aqueous solution obtained under the stirring conditions described above has been sifted.

The degree of dissolution is preferably at least 94%, more preferably at least 97%.

Hereinafter, the stirring conditions are described. A 1-L beaker (in the form of a cylinder having an inner diameter of 105 mm and a height of 150 mm, for example a 1-L beaker produced by Iwaki Glass Co., Ltd.) is filled with 1 L hard water cooled at 5° C. containing 71.2 mg $CaCO_3$/L (molar ratio of Ca/Mg=7/3), and the water is kept at a temperature of 5° C. in a water bath and stirred with a stirrer (35-mm length, 8 mm diameter, for example Teflon SA (round and thin stirrer) produced by Advantec Co., Ltd.) at such a revolution rate (800 rpm) as to permit the vortex/water depth ratio to be approximately 1/3. 1.0000±0.0010 g of the particle group previously weighed out without any make-up is introduced into the water and dispersed under stirring, and stirring is continued. 60 seconds after the particle group is introduced, the particle group dispersion in the beaker is filtered through the standard screen of known weight (diameter, 100 mm) having 74 μm openings prescribed in JIS Z 8801, and together with the screen, the hydrated particle group remaining on the screen is recovered in an open vessel of known weight. The operation time of from initiation of filtration to recovery of the screen shall be 10±2 seconds. The recovered residue from the particle group is dried in an electric oven at 105° C. for 1 hour and then cooled in a silica gel-containing desiccator (25° C.) for 30 minutes. After cooling, the total weight of the dried detergent residue, the screen and the recovery vessel is determined, and the degree (%) of dissolution of the particle group is calculated using the above equation (1).

For the solubility of the detergent composition and for easy preparation, the water-soluble or disintegrating-in-water particle group in the present invention is contained in an amount of preferably 10 to 90% by weight, more preferably 30 to 80% by weight and most preferably 40 to 70% by weight in the layer containing the detergent composition.

The water-soluble or disintegrating-in-water particle group in the present invention is specifically a particle group obtained by spray-drying slurry containing at least one member selected from a water-soluble inorganic material, a water-insoluble or water-sparingly-soluble inorganic material and a water-soluble organic material, and/or a detergent particle group comprising a surfactant carried on said particle group.

The water-soluble inorganic material includes carbonates such as sodium carbonate, potassium carbonate, sodium bicarbonate and potassium bicarbonate, sulfates such as sodium sulfate, potassium sulfate and sodium sulfite, and chlorides such as sodium chloride. As the water-soluble material, use can be made of the one dissolved in an amount of 0.1 to 50 g in e.g. 100 g water at 20° C. (stirring rate, 800 rpm; stirring time, 10 minutes).

The water-insoluble or water-sparingly-soluble inorganic material includes hydrated silicates having a three-layer structure, called smectites clay, for example swelling clay minerals such as montmorilonite, beedelite, nontronite, hectorite and saponite. For example, use can be made of commercial products such as Bengel (Hojyunyoko Co., Ltd.), Kunipia (Kunimine Kogyo Co., Ltd.), Smecton (Kunimine Kogyo Co., Ltd.) and Laponite (Laporte Ltd.). Use is also made of inorganic materials having a primary particle diameter of 50 μm or less, such as crystalline aluminosilicate (zeolite), crystalline silicates (e.g. SKS-6 from Clariant Japan Ltd.) and Britesil (The PQ Corporation). As the water-sparingly-soluble inorganic material, use can be made of the one dissolved in an amount of less than 0.1 g in e.g. 100 g water at 20° C. (stirring rate, 800 rpm; stirring time, 10 minutes).

The water-soluble organic material includes known surfactants or organic metal-ion scavengers such as ethylenediaminetetraacetic acid and citrates, and polycarboxylate polymers such as acrylate-maleate copolymers (e.g. Sokalan CP 5 from BASF). As the water-soluble organic material, use can be made of the one dissolved in an amount of at least 0.1 g in e.g. 100 g water at 20° C. (stirring rate, 800 rpm; stirring time, 10 minutes).

The particle group may comprise a combination of the components described above, and such composite particle group may comprise the water-soluble inorganic material and the water-insoluble or water-sparingly-soluble inorganic material and/or the water-soluble organic material. Particularly preferable in this case is a particle group (base granular group) obtained by spray-drying slurry containing the water-insoluble inorganic material etc., that is, a particle group obtained by spray-drying slurry containing at least one member selected from a water-soluble inorganic material, a water-insoluble or water-sparingly-soluble inorganic material and a water-soluble organic material. A detergent particle group is also preferable as the composite particle group. The detergent particle group is preferably the one comprising a surfactant carried on a base granular group composed of a water-insoluble inorganic material, a water-soluble polymer and a water-soluble salt, i.e. on a particle group obtained by spray-drying slurry containing at least one member selected form a water-soluble inorganic material, a water-insoluble or water-sparingly-soluble inorganic material and a water-soluble organic material.

The water-insoluble inorganic material used in the base granular group in the detergent particle group is preferably the one having an average primary particle diameter of 0.1 to 20 μm, for example, crystalline or amorphous aluminosilicates, silicon dioxide, hydrated silicic acid compounds, and clay compounds such as pearlite and bentonite, among which crystalline aluminosilicates are preferable in respect of the ability to sequester metal ions and the ability of the surfactant to absorb oil.

The water-soluble polymer used in the base granular group in the detergent particle group includes carboxylate-based polymers, carboxymethyl cellulose, soluble starch, sugars etc., among which carboxylate-based polymers having molecular weights of several thousand to a hundred thousand are preferable in respect of the ability to sequester metal ions, the ability to disperse solid staining particles and the ability to prevent redeposition. In particular, acrylate-maleate copolymers and polyacrylates (alkali metal salts, ammonium salts, amine salts etc.) are preferable.

The water-soluble salt used in the base granular group in the detergent particle group includes alkali metal salts such as carbonate radical, hydrogen carbonate radical, sulfate radical, sulfite radical, hydrogen sulfate radical, hydrochloride radical and phosphate radical, water-soluble inorganic salts such as ammonium salt and amine salt, and low-molecular weight water-soluble organic salts such as citrate and fumarate. The inorganic salts are preferable because their reaction with water generates heat of hydration heat and heat of solution by which bubbles from the detergent particles can be thermally expanded to promote disintegration of the particles.

The base granular group preferably has such localized structure that the water-soluble polymer and/or the water-soluble salt is distributed in larger amounts in the vicinity of the surface than in the inside. The base granular group having this structure can realize high-rate dissolution because the water-soluble components in the vicinity of the surface dissolve rapidly in water, thus permitting the base granular group to promote the behavior of dissolution starting from the surface thereof. In the most preferable mode of realizing high-rate dissolution, the base granular group is composed of bubble-releasing detergent particles having localized structure.

In the constitution of the base granular group in the detergent particle group, the water-insoluble inorganic material is preferably 20 to 90% by weight, more preferably 30 to 75% by weight and most preferably 40 to 70% by weight. The water-soluble polymer is preferably 2 to 30% by weight, more preferably 3 to 20% by weight and most preferably 5 to 20% by weight. The water-soluble salt is preferably 5 to 78% by weight, more preferably 10 to 70% by weight and most preferably 20 to 60% by weight. In these ranges, the base granular group is structured favorably such that it is coated in the vicinity of the surface thereof with the water-soluble components, and a coating layer is sufficiently formed on the surface of the particle, thus giving sufficient strength to the particles. These ranges are also preferable in respect of the solubility of the detergent composition. In addition to these three components, a known surfactant and an additive such as fluorescent dye, pigment and dye may be contained in the base granular group.

The surfactant carried on the base granular group in the detergent particle group includes anionic surfactants, nonionic surfactants, amphoteric surfactants and cationic surfactants, and it is preferable that anionic surfactants and nonionic surfactants are used singly or in combination.

The anionic surfactants are preferably sulfates of alcohol or alcohol ethoxylate, alkyl benzene sulfonates, paraffin sulfonates, α-olefin sulfonates, α-sulfo-fatty acid or ester salts thereof, and fatty acid salts. In particular, straight-chain alkyl benzene sulfonates whose alkyl chain contains 10 to 14 carbon atoms, preferably 12 to 14 carbon atoms, are preferable, and their counter ions are preferably alkali metals and amines, more preferably sodium, potassium, monoethanolamine and diethanolamine.

The nonionic surfactants are preferably polyoxyalkylene alkyl ether, polyoxyalkylene alkyl phenyl ether, alkylene polyglycoside, polyoxyalkylene sorbitan fatty ester, polyoxyalkylene glycol fatty ester, polyoxyethylene polyoxypropylene block polymer, and polyoxyalkylene alkylol amide. In particular, polyoxyalkylene alkyl ether having an HLB value of 10.5 to 15.0, particularly 11.0 to 14.5 (calculated by the Griffin method), having 4 to 20 moles of alkylene oxide such as ethylene oxide (referred to hereinafter as EO) and propylene oxide (referred to hereinafter as PO) added to $C_{10-18}$ alcohol is preferable.

For detergency, the amount of the surfactant is preferably 5 to 80 parts by weight, more preferably 5 to 60 parts by weight, further preferably 10 to 60 parts by weight and most preferably 20 to 60 parts by weight relative to 100 parts by weight of the base granular group.

The other water-soluble or disintegrating-in-water particle group includes granules containing oxygen, granules containing softener components such as quaternary ammonium salt, granules containing foam-controlling components such as dimethyl silicone, and granules containing a perfume.

For improvement in solubility, the water-soluble or disintegrating-in-water particles such as detergent particles are present preferably at a density of at least 10 particles/$cm^2$ surface of the layer containing the detergent composition.

Now, a method of separating the water-soluble or disintegrating-in-water particle group from the detergent composition is described. First, 10 g detergent composition is dispersed and dissolved in 1 L ethanol (special grade) in a 1-L beaker (inner diameter 105 mm). The sample is stirred and sonicated for 30 minutes in such an extent as not to destroy the particle group. After the sample is dispersed and dissolved, the remaining particle group is separated by filtration with a screen of 200 mesh size and dried at 105° C. for 1 hour in an electric oven. After drying, the particle group is transferred to a desiccator and cooled by leaving it for 2 hours at room temperature. The particle group can thus be separated.

[Detergent Composition]

The detergent composition in the present invention is composed essentially of a surfactant and a builder component, but when the above-described detergent particle group is used as the water-soluble or disintegrating-in-water particle group, the detergent composition is composed of the detergent particle group and other components. Further, when the composite particle group obtained by spray-drying the water-insoluble inorganic material etc. is used, the detergent composition is composed of the composite particle group and detergent components such as surfactant etc.

The surfactant may be the same surfactant as carried on the base granular group in the detergent particles. For detergency, the content of the surfactant in the detergent composition is preferably 5 to 80% by weight, more preferably 20 to 60% by weight and most preferably 30 to 50% by weight. Particularly for easy regulation of the sheet's flexibility, nonionic surfactants are preferable, and particularly preferably used are adducts of $C_{10-16}$ alcohol with 5 to 10 moles of EO and adducts of $C_{10-16}$ alcohol with 4 to 12 moles of EO and 0.1 to 4 moles of PO wherein EO and PO may have been polymerized at random or in block. In a preferable mode, the nonionic surfactant may be used in combination with a polyalkylene glycol with a pour point of 40° C. or more, such as polyethylene glycol. The content of the polyalkylene glycol is preferably 0.3 to 30% by weight, more preferably 1.5 to 14% by weight. The ratio of the nonionic surfactant to the polyalkylene glycol by weight is from 98/2 to 70/30, preferably from 95/5 to 80/20. The total content of the nonionic surfactant and the polyalkylene glycol is preferably 3 to 50% by weight, more preferably 6 to 30% by weight. Simultaneous use of the nonionic surfactant and the anionic surfactant is also preferable, and in this case, it is preferable for detergency that the total content of the two is preferably 50 to 100% by weight and particularly 70 to 100% by weight of the surfactant components. Further, the ratio of the nonionic surfactant to the anionic surfactant (nonionic surfactant/anionic surfactant) by weight is preferably from 100/0 to 10/90, more preferably from 90/10 to 50/50.

The builder includes e.g. inorganic builders such as carbonates, crystalline aluminosilicates, amorphous aluminosilicates, crystalline silicates, amorphous silicates, phosphates and borates, as well as organic builders such as nitrilo triacetate, ethylenediamine tetraacetate, tartrate, citrate and acrylic acid (co) polymers, which are in the from of salts with alkali metals such as sodium, potassium etc. In particular, crystalline aluminosilicates are preferable for their ability to sequester metal ions. For improvement in detergency, the content of the builder in the detergent composition is preferably 5 to 70% by weight, more preferably 0.10 to 60% by weight and most preferably 15 to 55% by weight.

For the detergency and flexibility of the laundry detergent sheet, the ratio of the surfactant to the builder (surfactant/builder) is preferably from 1/5 to 10/1 (ratio by weight), more preferably from 1/3 to 3/1 and most preferably from 1/2 to 3/2.

Further, the detergent composition of the present invention can contain additives known in the field of clothing detergent, such as bleaching agents (percarbonate, perborate, bleaching activator etc.), redeposition inhibitors (carboxymethyl cellulose etc.), softeners, reducing agents (sulfite etc.), fluorescent brighteners, defoaming agents (silicone etc.), perfumes etc.

For preventing blocking resulting from dissolution of the water-soluble substrate and for preventing drying of the detergent composition, the water content in the detergent composition of the present invention is preferably 0.1 to 15% by weight, more preferably 1.5 to 10% by weight and most preferably 2 to 7% by weight. This water content does not include crystal water in zeolite, carbonate, citrate etc.

In the present invention, the layer of the detergent composition is formed preferably from the water-soluble or disintegrating-in-water particle group and other components, particularly from a dough-like material containing the detergent particle group and the binder component. For forming the detergent composition into a dough-like material, the hardness of penetration thereof at 25° C. is preferably 0.1 to 20 kg/cm$^2$, more preferably 0.5 to 15 kg/cm$^2$ and most preferably 1.5 to 10 kg/cm$^2$. The above-mentioned dough-like material is a material fabricated from the powdered composition and a fluid material such as liquid, paste, gel etc. The fluid material includes those materials rendered fluid by heating or stress. The penetration hardness can be determined by measuring stress exerted on an adaptor (circle with a 1 cm$^2$ bottom) of a rheometer (FUDOH RT-2010J-CW) when the adaptor is pushed against the surface of the detergent composition kept at 25° C., thus penetrating by 2 cm at a penetration rate of 30 cm/min into the detergent composition. The dough-like material can be produced by a universal stirrer, a kneader etc. suitable for stirring at high viscosity. By adding a polyalkylene glycol having a molecular weight of 2000 or more, the dough-like material can be produced in a short time.

The viscosity of the dough-like material (Tokyo Keiki DVM-B type rotor No. 4, a revolution rate of 3 rpm, 25° C.) is preferably at least 100,000 mPa's, more preferably at least 200,000 mPa's.

For low-temperature solubility and simplicity, the thickness of the layer containing the detergent composition is preferably less than 1 cm, more preferably 0.03 to 0.8 cm, more preferably 0.07 to 0.5 cm. The layer containing the detergent composition in the present invention may be in the form of paste etc. besides the form of dough.

[Water-Soluble Substrate]

The water-soluble substrate in the present invention is joined on both sides of the layer containing the detergent composition, and its function is to keep the shape of the sheet of laundry detergent.

The water-soluble substrate in the present invention includes (i) water-soluble film, (ii) water-soluble nonwoven fabric or woven fabric, (iii) water-soluble laminated substrate consisting of a water-soluble film and said water-soluble nonwoven fabric or woven fabric, and (iv) laminated material formed from a water-soluble film and a web made of water-soluble fibers. In particular, (iv) is preferable in respect of simplicity and prevention of blocking among the laundry detergent sheets due to humidity.

The water-soluble substrate in the present invention includes water-soluble substrates including alkali-resistant water-soluble polymers such as polyvinyl alcohol (referred to hereinafter as PVA), polyvinyl pyrrolidone, pullulan, polyacrylamide, polyacrylic acid or polyacrylate, polymethacrylic acid or polymethacrylate, polyitaconic acid or polyitaconate, polyethylene oxide, polyvinyl methylene ether, xanthane gum, guar gum, collagen, carboxymethyl cellulose, hydroxyethyl cellulose and hydroxypropyl cellulose.

Particularly preferably used is partially saponified PVA having a degree of saponification of less than 96 mol-% or saponified anionic group-modified PVA having a degree of saponification of at least 96 mol-%, preferably at least 98 mol-% and an average polymerization degree of 250 to 3000, preferably 500 to 2500. Its monomer having anionic group includes unsaturated carboxylic acids such as acrylic acid, crotonic acid, maleic acid, fumaric acid and itaconic acid, unsaturated sulfonic acids, or esters thereof or anhydrides thereof, and particularly maleic acid, itaconic acid and 2-acrylamide-methylpropanesulfonic acid are preferable. The degree of modification of the anionic group is 0.1 to 8 mol-%, preferably 1 to 5 mol-% relative to the amount of total monomer units in the whole molecule.

Other water-soluble substrates include those described in JP-A 10-72599, column 5, line 47 to column 6, line 31.

To confer processability, softness, blocking resistance and hydrophilicity, the water-soluble substrate in the present invention includes water-soluble substrates containing plasticizers based on polyvalent alcohols such as ethylene glycol, propylene glycol and glycerin or anionic or cationic surfactants. The thickness of the water-soluble substrate is varied depending on the type, properties and amount of the detergent composition, but for softness, flexibility and usability, its thickness is preferably 5 to 200 $\mu$m, particularly 10 to 100 $\mu$m.

The laminated material formed from a water-soluble film and a web made of water-soluble fibers, mentioned in (iv) above, is a laminated material with a basis weight of not more than 50 g/m$^2$, formed at least from a water-soluble PVA type film having a melting point of 140 to 220° C. and a web composed of water-soluble PVA type fibers having a melting point of 140 to 220° C. [also referred to hereinafter as laminated material (iv)]. A preferable example of the web-forming fibers in the laminated material (iv) is PVA type fibers soluble in low-temperature water described in JP-A 8-118559. For the solubility of the resulting laminated material and from an economical viewpoint, the fibers are more preferably partially saponified PVA type fibers. The partially saponified PVA refers to the one having a degree of saponification of 70 to less than 96 mol-% and an average polymerization degree of 250 to 3000, preferably 500 to 2500. Such PVA type fibers are crimped and cut to form staple fibers which in turn are split by e.g. a card to form a web. For solubility, the web is more preferable than nonwoven fabric.

The water-soluble PVA type film in the laminated material (iv) can make use of various kinds of modified PVA type film. In particular, the surface of the film brought into contact with the detergent composition is preferably a completely saponified PVA type film, so that even if the film is contacted with the detergent component in the laundry detergent during long-term storage, the ability of the laminated material to be dissolved in water is not deteriorated. As the completely saponified PVA use can be made of the water-soluble one having a degree of saponification of at least 96 mol-%, preferably at least 98 mol-%. In particular, completely saponified anionic group-modified PVA having an average polymerization degree of 250 to 3000, preferably 500 to 2500 is preferable. The monomer forming the completely saponified anionic group-modified PVA, that is, the anionic group-containing monomer is the same as in the saponified anion-modified PVA described above.

As the melting point of the fibers, the temperature at which an endothermic peak of the fibers appears upon heating at a rate of 10° C./min. is determined using a differential scanning calorimeter (DSC-20) manufactured by Mettler Ltd.

The laminated material (iv) is formed from at least web and film. For example, a web is laminated on a film and hot-pressed in this state to give the laminated material (iv) composed of the web and film. For easiness of the process and from an economical point of view, the method of forming the laminated material by bonding a web to a film by hot pressing on a heating embossing roll having a contact bonding area of preferably 10 to 50% is particularly preferable because not only fixing of fibers in the web but also fixing of the whole web to the film can be simultaneously effected. The above hot press method is also preferable in respect of processability and improvements of the feeling to in the touch of the product and in resistance to dissolution upon contacting with wet hands.

In the laminated material (iv), other alkali-resistant water-soluble polymers may be used in the starting materials unless the effect of the present invention is not deteriorated.

The basis weight of the laminated material (iv) is not higher than 50 g/m$^2$, preferably 10 to 50 g/m$^2$ and particularly preferably 30 to 45 g/m$^2$. From the viewpoint of solubility in cold water and production costs, the basis weight is preferably not higher than 50 g/m$^2$. Further from the viewpoint of strength upon contacting with wet hands and processability, the basis weight is preferably at least 10 g/m$^2$. The thickness of the laminated material is varied depending on the type, properties and amount of the detergent composition, but for softness and usability, its thickness is preferably 5 to 200 $\mu$m, more preferably 10 to 110 $\mu$m.

The laminated material (iv) is preferably in such conditions that when the laminated material (4 specimens, 3 cm×3 cm) is introduced into 1 L distilled water at 10° C., mixed for 8 minutes under stirring (at 550 rpm with a stirrer having the whole length of 35 mm and the maximum diameter of 7.5 mm) and passed through a screen having 125 $\mu$m openings, no residue is recognized, or residues remain in an amount of less than 2% by weight based on the laminated material. That is, the degree of dissolution of the laminated material is preferably at least 98%. For solubility and blocking resistance, the laminated material (iv) may be provided with uneven portions in checked pattern by embossing etc.

[Laundry Detergent Sheet]

The laundry detergent sheet of the present invention comprises a layer containing a detergent composition and, on both sides of the layer, a water-soluble substrate joined. The laundry detergent sheet can be produced by mixing a detergent composition with a water-soluble or disintegrating-in-water particle group having an average particle diameter of 60 to 2000 $\mu$m, forming the resulting mixture into a layer, and joining a water-soluble substrate on both sides of the resulting layer. The laundry detergent sheet can be produced by a method of forming a dough-like detergent composition into a sheet and then joining a one- or more-layered water-soluble substrate on both sides thereof, a method of compression-molding a dough-like detergent composition by a roller or a press machine while feeding it between two or more sheets of a water-soluble substrate rotated and transferred by a roller etc., a method of applying a dough-like detergent composition onto a water-soluble substrate and then joining another water-soluble substrate on the other side thereof, or a method of joining a water-soluble substrate on both those sides of a dough-like detergent composition which were impregnated with a water-soluble substrate. Joining is preferably joining on the whole surface, but partial joining can also be used insofar as the shape or performance of the detergent sheet article is not deteriorated.

In a particularly preferable embodiment, the laundry detergent sheet of the present invention comprises the water-soluble substrate joined on both sides of the layer containing a water-soluble or disintegrating-in-water particle group and a binder component.

For solubility, flexibility and usability, the thickness of the laundry detergent sheet of the present invention is preferably 1 cm or less, more preferably 0.05 to 0.7 cm and most preferably 0.1 to 0.5 cm, and its area density is preferably 0.005 to 1.8 g/cm$^2$, more preferably 0.02 to 0.7 g/cm$^2$.

The laundry detergent sheet may be formed by sealing the outside thereof (e.g. the water-soluble substrates joined on both sides of the layer containing a detergent composition) to prevent a loss in the contents, or by machining it for easy breakage, or by making a roll of the laundry detergent.

Because the sheet of laundry detergent of the present invention comprises a water-soluble or disintegrating-in-water particle group to dissolve or disintegrate in water, the surface area of the detergent composition is increased and the solubility is improved significantly. This invention is a method of feeding a detergent for washing or is used for feeding a detergent.

EXAMPLES

Examples 1 to 12 and Comparative Example 1 to 2

[Preparation of the Water-Soluble Substrate]

An aqueous solution containing 15% by weight of itaconic acid-modified PVA (degree of modification of 3 mole-%) having an average polymerization degree of 1700 and a degree of saponification of 99.9% and 2% by weight of glycerine was prepared, formed into a thin film and dried by hot air to prepare a water-soluble film of 20 $\mu$m in thickness (expressed as "film" in Table 2).

Separately, the same PVA was used to prepare a water-soluble nonwoven fabric having openings of 30 g/m$^2$ according to Example 2 in JP-A 8-3848. This nonwoven fabric was joined on the above water-soluble film and heat-embossed to prepare a laminated water-soluble substrate A (expressed as "laminate A"in Table 2. Further, a laminated water-soluble substrate B (expressed as "laminate B" in Table 2) was obtained in the same manner as above except that a maleic acid-modified PVA (degree of modification of 3 mol-%) having an average polymerization degree of 1700 and a degree of saponification of 97.0% was used in place of the itaconic acid-modified PVA.

[Preparation of the Base Particle Group]

48 kg aqueous solution containing 50% by weight of sodium dodecylbenzenesulfonate [Neopelex F65 (Kao Corporation), expressed as LAS-Na in Table 1] and 135 kg aqueous solution containing 40% by weight of sodium polyacrylate (average molecular weight of 10000, expressed as PPA-Na in Table 1) were added to 465 kg water at 55° C. After the mixture was stirred for 15 minutes. 120 kg sodium carbonate (Dense Ash, Central Glass Co., Ltd.), 60 kg sodium sulfate (neutral anhydride), 9 kg sodium sulfite, and 3 kg fluorescent dye (Chinopearl CBS-X produced by Ciba-Geigy AG) were added thereto. After the mixture was further stirred for 15 minutes, 300 kg zeolite 4A (average particle diameter of 3.5 μm, Tosoh Corporation) was added thereto and stirred for 30 minutes to give uniform slurry. The final temperature of this slurry was 58° C.

This slurry was fed to a spray-drying tower and sprayed at a spray pressure of 25 kg/cm$^2$ through spray nozzles near the top of the tower, to give a base granular group I. The base granular group I was composed of 50% by weight of zeolite, 9% by weight of sodium polyacrylate, 20% by weight of sodium carbonate, 10% by weight of sodium sulfate, 1.5% by weight of sodium sulfite, 4% by weight of sodium dodecylbenzenesulfonate, 0.5% by weight of the dye, and 5% by weight of water. Separately, base granular groups II to IV were also obtained in the same way as the base granular groups I, using the compounding ingredients shown in Table 1.

TABLE 1

| | | Base Granular Group No. | | | |
|---|---|---|---|---|---|
| | | I | II | III | IV |
| Compounding Ingredients (weight %) | zeolite 4A | 50 | 64 | 60 | 32 |
| | LAS-Na | 4 | 0 | 0 | 0 |
| | PAA-Na | 9 | 8 | 5 | 6 |
| | AA/Macopolymer[a)] | 0 | 0 | 5 | 6 |
| | sodium carbonate | 20 | 17 | 14 | 44 |
| | sodium sulfate | 10 | 5 | 8 | 7 |
| | sodium sulfite | 1.5 | 0 | 2 | 0 |
| | fluorescent dye | 0.5 | 1 | 1 | 1 |
| | water | 5 | 5 | 5 | 4 |
| | total | 100 | 100 | 100 | 100 |

Note: a) is an acrylic acid/maleic acid copolymer with an average molecular weight of 80,000 in the acrylic acid/maleic acid ratio of 8/2 (molar ratio)

[Preparation of the Detergent Particle Group]

100 parts by weight of the base granular group I was introduced into a Readyge mixer (volume of 20 L with a jacket, Matsuzaka Giken Co., Ltd.), and 23 parts by weight of an ethylene oxide (7 moles on the average) adduct to $C_{12-14}$ secondary alcohol (Softanol 70H, Nippon Shokubai Co., Ltd.) heated at 50° C. were added thereto in 2 minutes under stirring with a main shaft and a chopper, then stirred for 4 minutes and discharged. The average particle diameter of the resulting detergent particle group was 230 μm, and a particle group having a particle diameter of 2000 μm or more was 0.1% by weight while a particle group having a particle diameter of less than 60 μm was 0.1% by weight. Further, 0.5 g of the detergent particle group was introduced into 1 L water at 10° C., stirred at a revolution rate of 800 rpm for 5 minutes, and sifted with a screen of 200 mesh size, and as a result, no residue was recognized on the screen.

[Preparation of the Sheet of Laundry Detergent]

A detergent composition comprising the ingredients shown in Table 2 was introduced into a universal mixing stirrer (model 5DM-03-r, Dalton Co., Ltd.), kept at 25° C. and stirred until it was formed into a dough-like detergent composition. The dough-like detergent composition was formed by Dough Sheeter (Econom STM513, Seaver Ltd.) into a laminated material of 0.15 cm in thickness and cut into 5 cm×10 cm pieces.

When the surface of the layer containing the detergent composition was observed, the presence of about 20 detergent particles/cm$^2$ could be confirmed, and when a section of the thin layer was observed, the presence of 8 detergent particles on the film thickness×film thickness area was confirmed.

This layer material was sandwiched between two sheets of laminated water-soluble substrate A or B and then heat-sealed therearound to give each sheet of laundry detergent. The average weight thereof was 10 g, and the average density thereof was 0.2 g/cm$^2$. Then, the degree of dissolution of each sheet of laundry was evaluated according to the following measurement method. The results are shown in Table 2.

[Method of Measuring the Degree of Dissolution]

10 g a laundry detergent sheet was introduced into 30 L tap water at 5° C. in a washing machine (Ginga 3.6 (VH360S1), Toshiba Corporation). This sample was stirred for 5 minutes at "strong rotation" and then dehydrated, and the water was discharged. Detergent residues on a drain outlet equipped with a 500 μm screen and in the washing machine were recovered, air-dried at room temperature, and weighed to determine the degree of dissolution according to the following equation: Degree of dissolution (%)=[(weight before introduction−weight of residues)/(weight before introduction)]×100

In this test, the degree of dissolution is desirably 50% or more.

Comparative Examples 1 & 2

Using the detergent compositions shown in Table 2, dough-like materials were prepared in the same manner as in the Examples. Sheets of laundry detergent were prepared using two sheets of laminate water-soluble substrate A in the same manner as above and evaluated in the same manner as in the Examples. The results are shown in Table 2.

TABLE 2

| | | Examples | | | | | | | | | | | | Comparative Examples | |
|---|---|---|---|---|---|---|---|---|---|---|---|---|---|---|---|
| | | 1 | 2 | 3 | 4 | 5 | 6 | 7 | 8 | 9 | 10 | 11 | 12 | 1 | 2 |
| Compounding Ingredients (weight %) | | | | | | | | | | | | | | | |
| Nonionic surfactant | 1 | 15 | 15 | | | | | | | | | | | 30 | 15 |
| | 2 | | | 30 | 30 | 30 | 30 | | | 20 | 40 | 30 | 30 | | |
| | 3 | | | | | | | 30 | | | | | | | |
| | 4 | | | | | | | | 30 | | | | | | |

TABLE 2-continued

| | | Examples | | | | | | | | | | | | Comparative Examples | |
|---|---|---|---|---|---|---|---|---|---|---|---|---|---|---|---|
| | | 1 | 2 | 3 | 4 | 5 | 6 | 7 | 8 | 9 | 10 | 11 | 12 | 1 | 2 |
| LAS—MEA | | 15 | 15 | | | | | | | | | | | 30 | 15 |
| LAS—Na | | | | 3 | 3 | 3 | 3 | 3 | 3 | 2 | 1 | 1 | 3 | | 2 |
| AS—Na | | | | 3 | 3 | 3 | 3 | 3 | 3 | 2 | 1 | 1 | 3 | | |
| PEG | | 3 | 3 | 1 | 1 | 1 | 1 | 1 | 1 | | | 1 | 1 | 6 | 3 |
| Detergent particle group | | 50 | 50 | | | | | | | | | | | | |
| Base | I | | | 60 | | | | | | | | | | | |
| granular | II | | | | 60 | | | 60 | 60 | 60 | 50 | 50 | | | |
| group | III | | | | | 60 | | | | | | | | | |
| | IV | | | | | | 60 | | | | | | 60 | | |
| Zeolite | | 17 | 17 | | | | | | | | | | | 34 | 42 |
| Sodium carbonate | | | | | | | | | | 13 | 5 | 10 | | | 10 |
| Sodium sulfate | | | | | | | | | | | | 5 | | | 5 |
| Sodium sulfite | | | | | | | | | | | | 1 | | | 0.7 |
| Sodium Polyacrylate | | | | | | | | | | | | | | | 4.5 |
| Florescent dye | | | | | | | | | | | | | | | 0.3 |
| Water | | | | 3 | 3 | 3 | 3 | 3 | 3 | 3 | 3 | 1 | 3 | | 2.5 |
| Water-soluble base material | | film | laminate A | laminate A | laminate A | laminate A | laminate A | laminate A | laminate A | laminate A | laminate A | laminate A | laminate B | laminate A | laminate A |
| Degree of dissolution (%) | | 87 | 82 | 85 | 81 | 84 | 88 | 91 | 78 | 76 | 81 | 75 | 89 | 42 | 38 |

Notes:

Nonionic surfactant I: An addition product having about 7 moles of EO added to $C_{12-14}$ secondary alcohol.

Nonionic surfactant II: An addition product having 5 moles of on average EO, 2 moles on average of PO and 3 moles of EO added in this order to $C_{12-14}$ primary alcohol.

Nonionic surfactant III: An addition product having about 7 moles of EO and 3 moles on average of PO added in this order to $C_{12-14}$ primary alcohol Nonionic surfactant IV: An addition product having 7 moles on average of EO added to $C_{12-14}$ primary alcohol.

LAS-MEA: A linear-alkyl (number of carbon atoms: 10 to 13) benzene sulfonate monoethanolamine salt.

LAS-Na: Sodium linear-alkyl (number of carbon atoms: 10 to 13) benzene sulfonate.

AS-Na: Sodium linear-alkyl (number of carbon atoms: 10 to 13) sulfate.

PEG: Polyethylene glycol with an average molecular weight of 8000.

What is claimed is:

1. A method of producing a sheet of laundry detergent, which comprising mixing a detergent composition with a water-soluble or disintegrating-in-water particle group having an average particle diameter of 60 to 2000 $\mu$m, consisting of a particle group obtained by spray-drying slurry containing at least one member selected from a water-soluble inorganic material, a water-insoluble or water-sparingly-soluble inorganic material and a water-soluble organic material and/or a detergent particle group comprising a surfactant carried on said particle group, then forming the resulting mixture into a layer, and joining a water-soluble substrate on both sides of the resulting layer.

* * * * *